US009871328B2

(12) United States Patent
Lopes et al.

(10) Patent No.: US 9,871,328 B2
(45) Date of Patent: Jan. 16, 2018

(54) COVER ASSEMBLY AND ELECTRICAL CONNECTOR ASSEMBLY

(71) Applicant: TYCO ELECTRONICS BRASIL LTDA., Sao Paulo (BR)

(72) Inventors: Ednei Lopes, Braganca Paulista (BR); Rafael Kazuo Sato Toledo Leme, Braganca Paulista (BR); Natanael Marcondes Santos, Braganca Paulista (BR)

(73) Assignee: TYCO ELECTRONICS BRASIL LTDA., Sao Paulo (BR)

( * ) Notice: Subject to any disclaimer, the term of this patent is extended or adjusted under 35 U.S.C. 154(b) by 0 days.

(21) Appl. No.: 15/412,588

(22) Filed: Jan. 23, 2017

(65) Prior Publication Data

US 2017/0244200 A1 Aug. 24, 2017

Related U.S. Application Data

(60) Provisional application No. 62/296,662, filed on Feb. 18, 2016.

(51) Int. Cl.

| | |
|---|---|
| ***H01R 13/52*** | (2006.01) |
| ***H01R 13/66*** | (2006.01) |
| *H01R 4/22* | (2006.01) |

(52) U.S. Cl.

CPC ..... *H01R 13/665* (2013.01); *H01R 13/5213* (2013.01); *H01R 4/22* (2013.01)

(58) Field of Classification Search

USPC ..... 439/519, 521, 892, 936

See application file for complete search history.

(56) References Cited

U.S. PATENT DOCUMENTS 9,622,355 B2 * 4/2017 Stern ..... H05K 3/30

FOREIGN PATENT DOCUMENTS

| | | |
|---|---|---|
| DE | 4134613 A1 | 4/1992 |
| EP | 0438120 A1 | 7/1991 |

(Continued)

OTHER PUBLICATIONS

International Search Report, International Application No. PCT/B2017/050888, dated Feb. 16, 2017.

*Primary Examiner* — Tho D Ta

(57) ABSTRACT

A connector assembly having a cover assembly housing a first electrical component and a second electrical component. The cover assembly includes a mating connector receiving recess, a first component receiving recess and a second component receiving recess. A separating wall mechanically and electrically separates the first component receiving recess from the second component receiving recess. Latches are positioned in the first and second component receiving recess proximate the mating connector receiving recess. The latches cooperate with the electrical components to maintain the electrical component in the component receiving recesses. A seal is provided about an inside perimeter of the mating connector receiving recess. Bus bars electrically connect the first electrical component to the second electrical component. Wherein when the cover assembly is mated to the mating connector, a sealed compartment is provided that protects the first electrical components and the second electrical components from the environment.

17 Claims, 7 Drawing Sheets

(56) References Cited

FOREIGN PATENT DOCUMENTS

| | | | |
|---|---|---|---|
| EP | 0989633 | A2 | 3/2000 |
| EP | 1020959 | A2 | 7/2000 |
| JP | 2006331991 | A | 12/2006 |
| WO | 2004102746 | A1 | 11/2004 |
| WO | 2014111133 | A1 | 7/2014 |

* cited by examiner

COVER ASSEMBLY AND ELECTRICAL CONNECTOR ASSEMBLY

CROSS-REFERENCE TO RELATED APPLICATION

This patent application claims the benefit of U.S. Provisional Patent Application Ser. No. 62/296,662 filed on Feb. 18, 2016, and entitled "COVER AND ELECTRICAL CONNECTOR ASSEMBLY", the disclosure of which is incorporated by reference as if fully rewritten herein.

FIELD OF THE INVENTION

The invention generally relates to a cover and an electrical housing assembly, and more particularly, to a cover for automotive application which is configured to receive a relay and another electrical component therein.

BACKGROUND OF THE INVENTION

Electrical systems in automobiles and the like often require multiple connectors and multiple relays for operation. These connectors and relays are separate components which may be housed in different locations requiring wiring harnesses and valuable space to be occupied.

It would, therefore, be beneficial to provide a cover assembly and electrical connector assembly which allows for a relay or other electrical component and a heater control unit or other electrical component to be positioned proximate to each other, thereby reducing the space required for the components. It would also be beneficial to provide a cover assembly and connector assembly which reduce the cost and complexity of the interconnections, and which reduce the assembly time required to assemble the components and the system.

SUMMARY OF THE INVENTION

An object is to provide a cover assembly and connector assembly which allows for a relay or other electrical component and a heater control unit or other electrical component to be positioned proximate to each other, thereby reducing the space required for the components.

An object is to provide a cover assembly and connector assembly in which the positioning of the components allows for the use of bus bars and the like, eliminating the need for more complex wire harnesses.

An object is to provide a cover assembly and connector assembly that reduce the cost and complexity of the interconnections.

An object is to provide a cover assembly and connector assembly which reduce the assembly time required to assemble the components and the system.

An object is to provide a cover assembly and connector assembly which form an environmentally sealed electrical housing assembly. The housing assembly forms a sealed compartment that protects the removable components from the environment. The housing assembly allows distribution of power switching functions and circuit protection to be distributed to a location near the electrical load instead of from a central location in a vehicle. The housing provides protection of the electrical components from the environment allowing placement of these components outside of a protective enclosure. The housing assembly may be placed in areas of harsh splash or the like. The choice of location is limited only by the integrity of connector seal.

An embodiment is directed to a connector assembly having a cover assembly, a first electrical component, a second electrical component and a mating connector. The cover assembly housing the first electrical component and the second electrical component. The cover assembly includes a mating connector receiving recess, a first component receiving recess and a second component receiving recess. A separating wall is positioned between the first component receiving recess and the second component receiving recess. The separating wall mechanically and electrically separates the first component receiving recess from the second component receiving recess. First latches are positioned in the first component receiving recess proximate the mating connector receiving recess. The first latches cooperate with the first electrical component to maintain the first electrical component in the first component receiving recess. Second latches are positioned in the second component receiving recess proximate the mating connector receiving recess. The second latches cooperate with the second electrical component to maintain the second electrical component in the second component receiving recess. A seal is provided about an inside perimeter of the mating connector receiving recess. The mating connector having bus bars to electrically connect the first electrical component to the second electrical component. Wherein when the cover assembly is mated to the mating connector, a sealed compartment is provided that protects the first electrical components and the second electrical components from the environment.

An embodiment is directed to a cover assembly for mating a first electrical component and a second electrical component to a mating connector. The cover assembly includes a mating connector receiving recess, a first component receiving recess and a second component receiving recess. A separating wall is positioned between the first component receiving recess and the second component receiving recess. The separating wall mechanically and electrically separates the first component receiving recess from the second component receiving recess. First latches are positioned in the first component receiving recess proximate the mating connector receiving recess. The first latches cooperate with the first electrical component to maintain the first electrical component in the first component receiving recess. Second latches are positioned in the second component receiving recess proximate the mating connector receiving recess. The second latches cooperate with the second electrical component to maintain the second electrical component in the second component receiving recess.

An embodiment is directed to a cover assembly for mating a first electrical component and a second electrical component to a mating connector. The cover assembly includes a mating connector receiving recess, a first component receiving recess and a second component receiving recess. A separating wall is positioned between the first component receiving recess and the second component receiving recess. The separating wall mechanically and electrically separates the first component receiving recess from the second component receiving recess. First latches have first resilient arms which extend from sidewalls of the first component receiving recess. First latching projections with first latching shoulders extend from the first resilient arms and extend into the first component receiving recess to cooperate with and maintain the first electrical component in the first component receiving recess. Second latches have second resilient arms which extend from sidewalls of the second component receiving recess. The second latching projections with second latching shoulders extend from the second resilient arms and extend into the second component receiving recess to cooperate with and maintain the second electrical component in the second component receiving recess.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
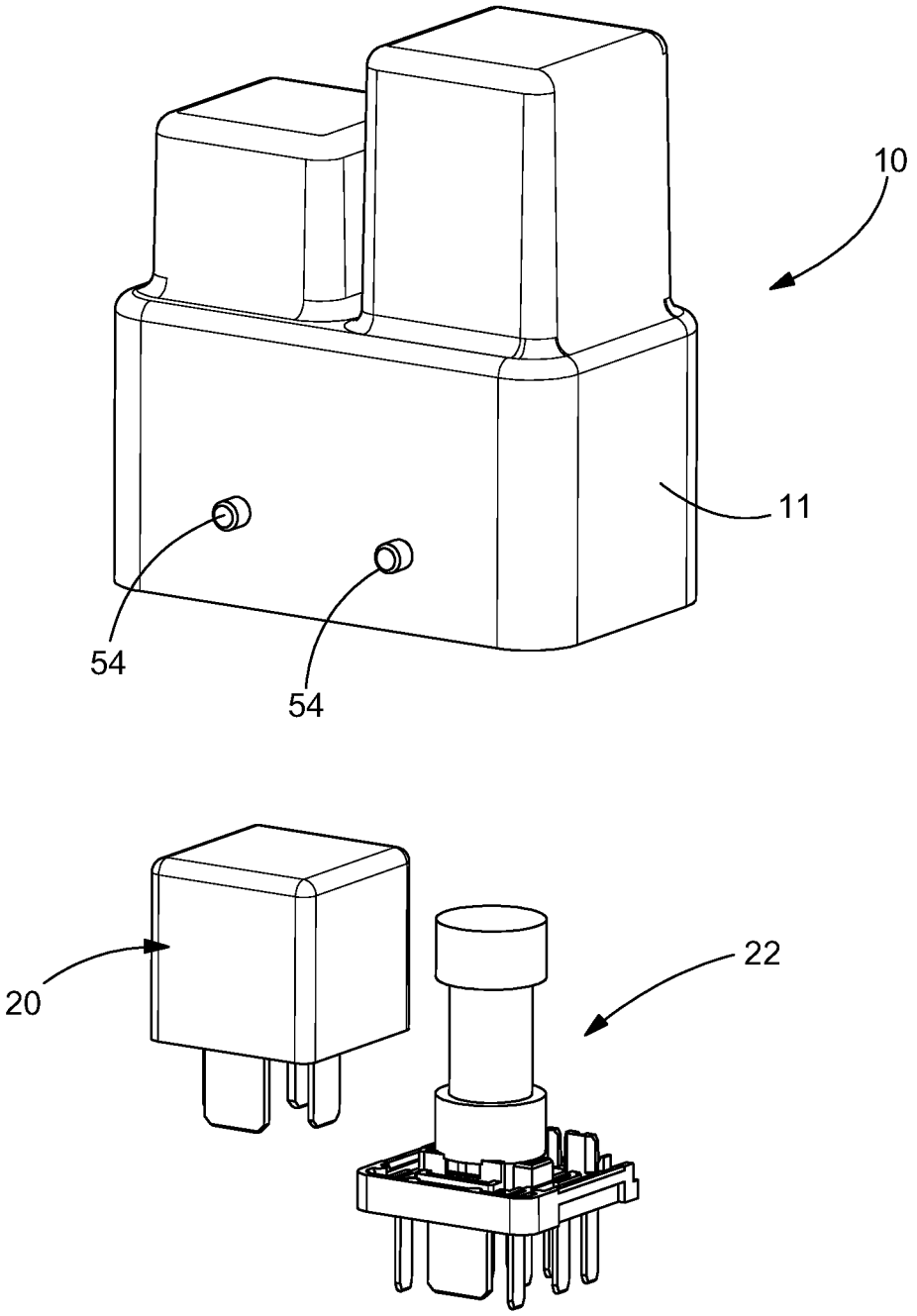
FIG. 1 is a perspective view of an illustrative cover assembly of the present invention with a relay and a heater control unit exploded from a cover.
Figure 2:
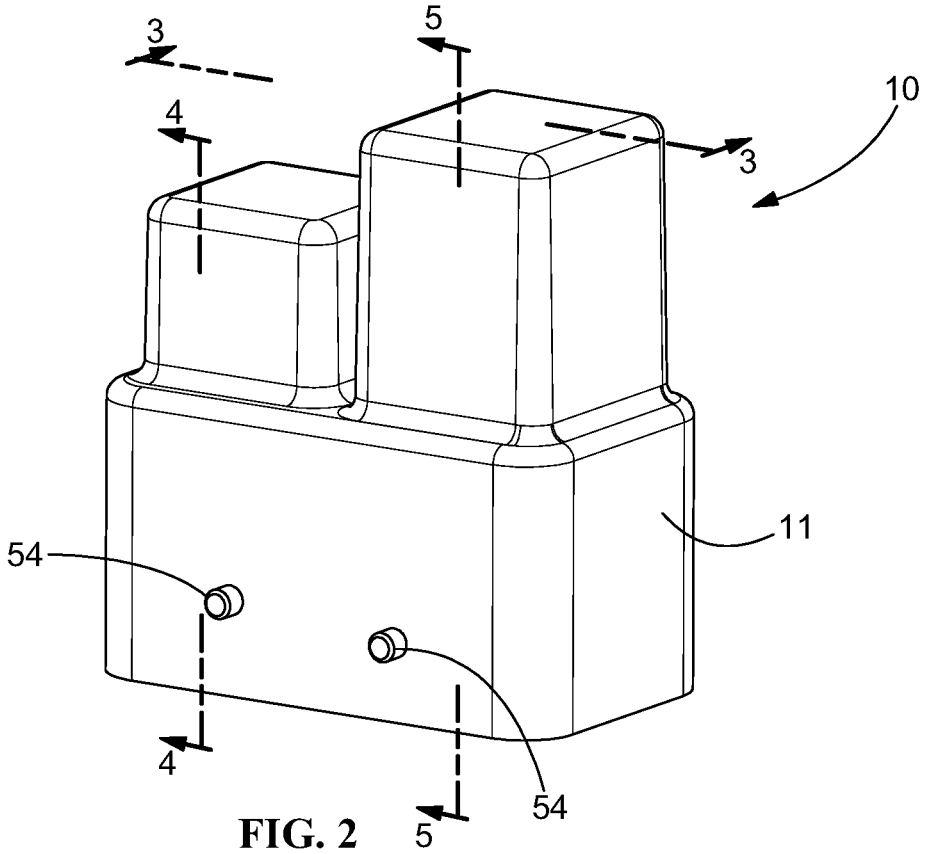
FIG. 2 is a perspective view of the cover assembly with the relay and the heater control unit inserted therein.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

Figure 3:
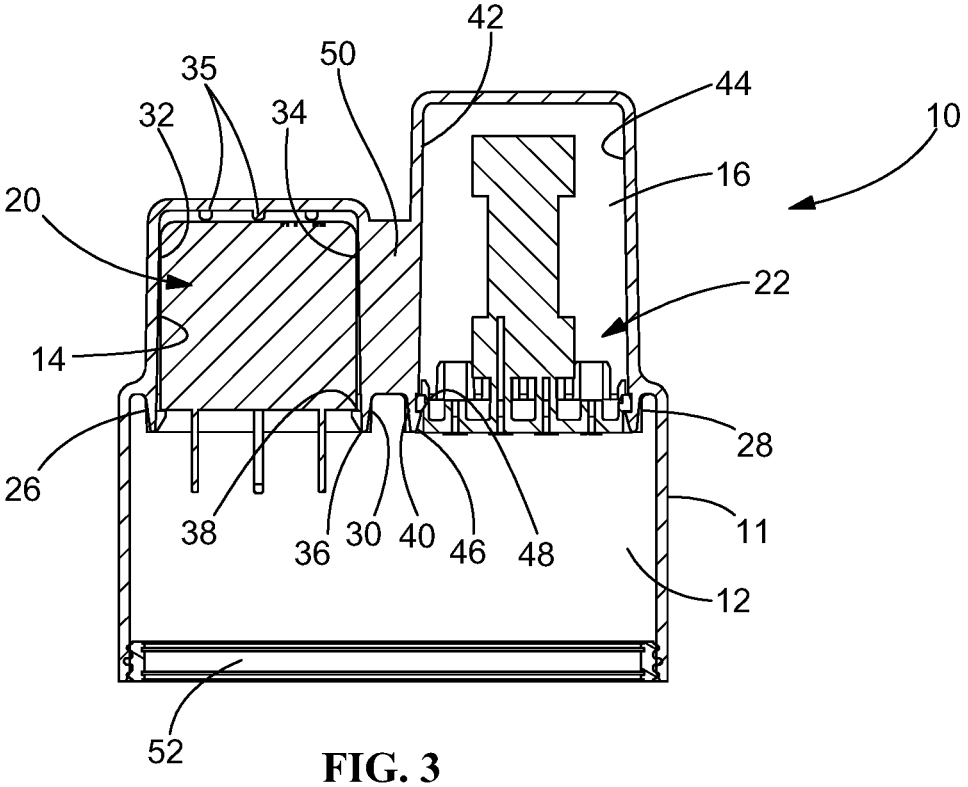
FIG. 3 is a cross-sectional view of the cover assembly taken along line 3-3 of FIG. 2.
Figure 4:
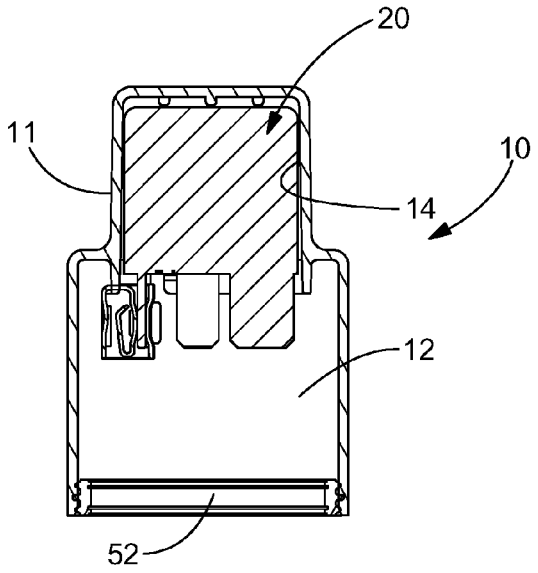
FIG. 4 is a cross-sectional view of the cover assembly taken along line 4-4 of FIG. 2.
Figure 5:
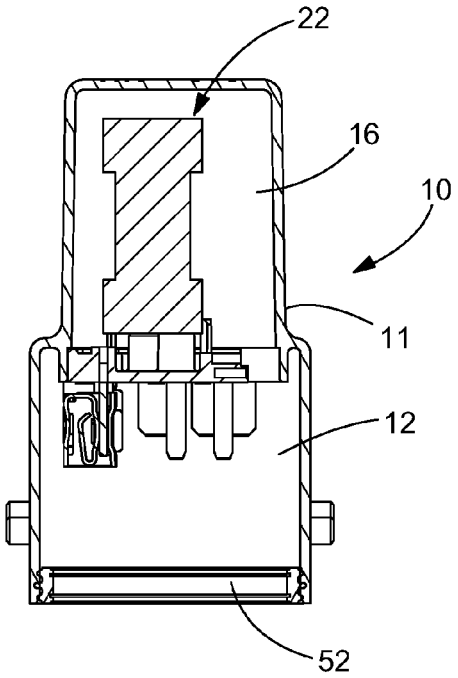
FIG. 5 is a cross-sectional view of the cover assembly taken along line 5-5 of FIG. 2.
Figure 6:
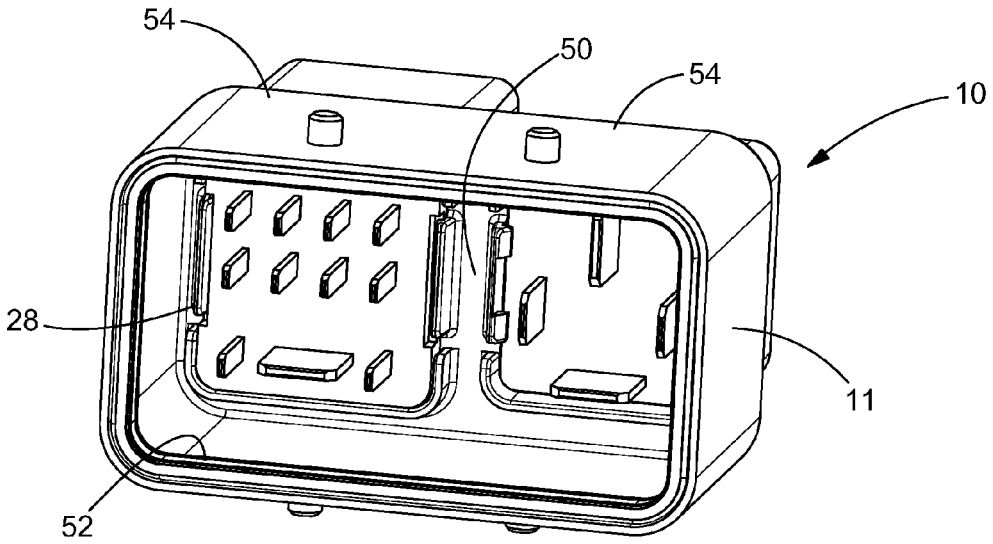
FIG. 6 is a bottom perspective view of the cover assembly of FIG. 2.

Referring to FIGS. 1 through 6, a cover assembly 10 includes a hybrid cover 11 for use in housing two electrical components is shown. As best shown in FIG. 3, the cover 11 has a mating connector receiving recess 12, a first electrical component receiving recess 14 and an additional second component receiving recess 16. In the embodiment shown, the first component receiving recess 14 is dimensioned to receive a first electrical component 20, such as, but not limited to, a relay therein and the second component receiving recess 16 is dimensioned to receive a second electrical component 22, such as, but not limited to, a heater control unit. However, other types of components may be housed in either the first component receiving recess 14 or the second component receiving recess 16.

First resilient latches 26 are positioned proximate the transition between the mating connector receiving recess 12 and the first component receiving recess 14. The latches 26 include resilient arms 30 which extend from sidewalls 32, 34 of the first component receiving recess 14. Latching projections 36 with latching shoulders 38 extend from the resilient arms 30 and extend into the first component receiving recess 14 to cooperate with and maintain the first electrical component 20 in the first component receiving recess 14. Spacing projections 35 may be provided in the first component receiving recess 14 to properly position the first electrical component 20.

Second resilient latches 28 are positioned between the mating connector receiving recess 12 and the second component receiving recess 16. The latches 28 include resilient arms 40 which extend from sidewalls 42, 44 of the component receiving recess 16. Latching projections 46 with latching shoulders 48 extend from the resilient arms 40 and extend into the second component receiving recess 16 to cooperate with and maintain the second electrical component 22 in the second component receiving recess 16.

In different illustrative embodiments of the cover 11, the dimensions of the first component receiving recess 14 may vary to accommodate different sized components. In addition, the positioning of the latches 26 may be varied to accommodate different sized components. In different illustrative embodiments of the cover 11, the dimensions of the component receiving recess 16 may vary to accommodate different sized components. In addition, the positioning of the latches 28 may be varied to accommodate different sized components.

A separating wall 50 is positioned between the first component receiving recess 14 and the component receiving recess 16. The wall 50 is provided to mechanically and electrically separate the first electrical component 20 from the second electrical component 22.

As best shown in FIGS. 3 through 6, a seal 52 may be provided about the inside perimeter of the connector receiving recess 12. Projections 54 extend from outside surfaces of the cover 11 proximate the connector receiving recess 12. In the illustrative embodiment shown, four projections 54 are provided with two on each side of the cover 11. The projections 54 have a generally cylindrical configuration.

While the cover 11 and cover assembly 10 are shown with two component receiving recess and one separating wall, additional components receiving recesses and separating walls may be provided without departing from the scope of the invention.

Figure 10:
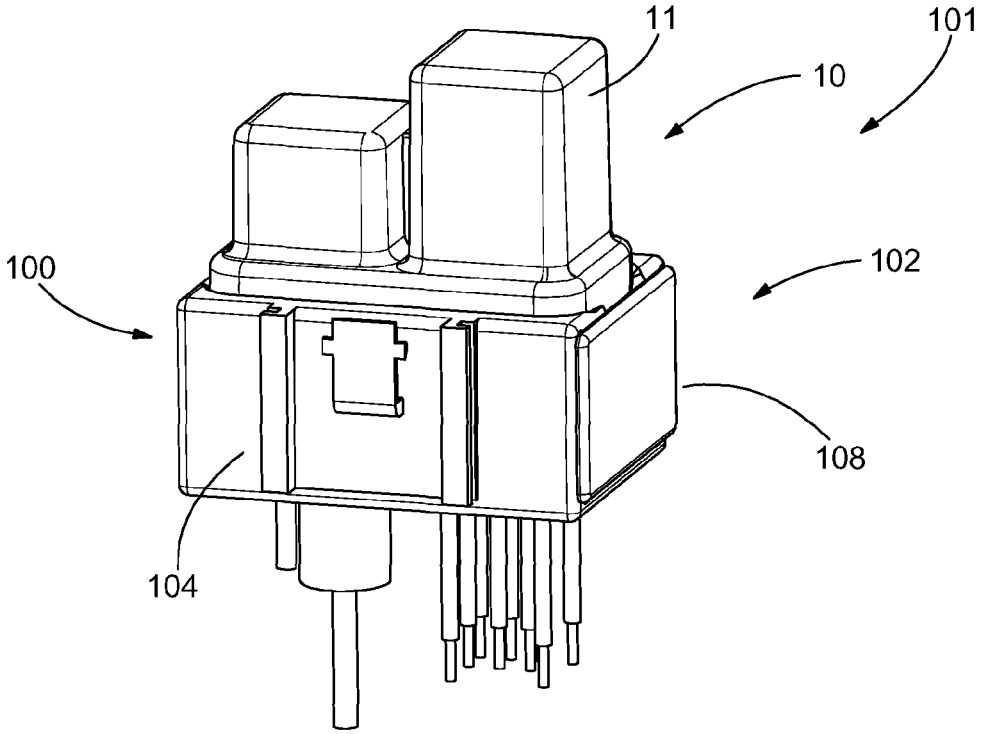
FIG. 10 is a perspective view of the cover assembly mated to the mating connector, the mating connector being in the closed position.

With the first electrical component 20 properly positioned and maintained in the first component receiving recess 14 by the resilient latches 26 and the second electrical component 22 properly positioned and maintained in the component receiving recess 16 by the resilient latches 28, the cover assembly 10 is moved into engagement with a mating connector 100 to form a connector assembly 101 (as best shown in FIG. 10).

As best shown in FIGS. 7 through 10, the mating connector 100 includes a slideable locking lever 102 for clamping the cover assembly 10 and the mating connector 100 together. The slideable locking lever 102 is accommodated displaceably in the housing 104 of the mating connector 100 in a direction of arrow 106. The slideable locking lever 102 includes an engagement or actuating surface 108, to which a displacement force can be applied for displacing the slideable locking lever 102.

The slideable locking lever 102 comprises side elements 110, 112. Respective first guide rails 114 and second guide rails 116 are provided in the side elements 110, 112. The first and second guide rails 114, 116 are formed, for example, as guide openings in this embodiment of the invention. However, the first and second guide rails may be in other configurations, such as, but not limited to, recesses.

The proposed direction for plugging together the cover assembly 10 and the mating connector 100 is indicated by arrow 118. The direction of the arrow 106, in which the slideable locking lever 102 can be displaced in the mating connector 110, extends substantially transversely to the direction of the arrow 118 for plugging together the cover assembly 10 and the mating connector 100. The first and second guide rails 114, 116 have step-down portions 120, 122 which extend in a direction substantially transverse to the plugging-together direction shown by the direction of the arrow 118 and substantially transverse to the sliding direction shown by the direction of the arrow 106. The first and second guide rails 114, 116 also comprise end portions 124, 126 which extend parallel to the sliding direction shown by the direction of the arrow 106.

The first and second guide rails 114, 116 cooperate with the associated projections 54 on the cover assembly 10 for securing or clamping the cover assembly 10 and the mating connector 100. When mated, the cover assembly 10 is inserted into a recess 128 which extends about the inside perimeter of the housing 104 of the mating connector 100. The recess 128 is dimensioned to receive the cover 11 and the projections 54 therein. As the cover 11 is moved into the recess 128, the projections are positioned in slots 121, 123 of the first and second guide rails 114, 116. The insertion of the cover assembly 10 continues until projections 54 are positioned in the step down portions 120, 122. The slidable locking lever 102 is then moved from the open position shown in FIG. 8 to the closed position shown in FIG. 10. As this occurs, the projections 54 are moved by the step down portions 120, 122 into the end portions 124, 126. In this position, the cover assembly 10 is fully mated and secured to the mating connector 100. To unmate the cover assembly 10 from the mating connector 100, the process is reversed, as the slidable locking lever 102 is moved from the closed position to the closed position.

Figure 7:
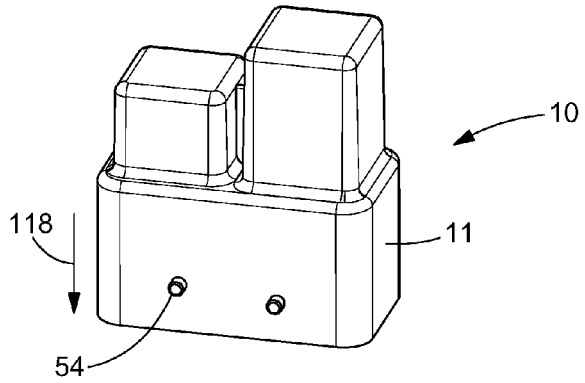
FIG. 7 is a perspective view of the cover assembly of FIG. 2 positioned proximate a mating connector.
Figure 7:
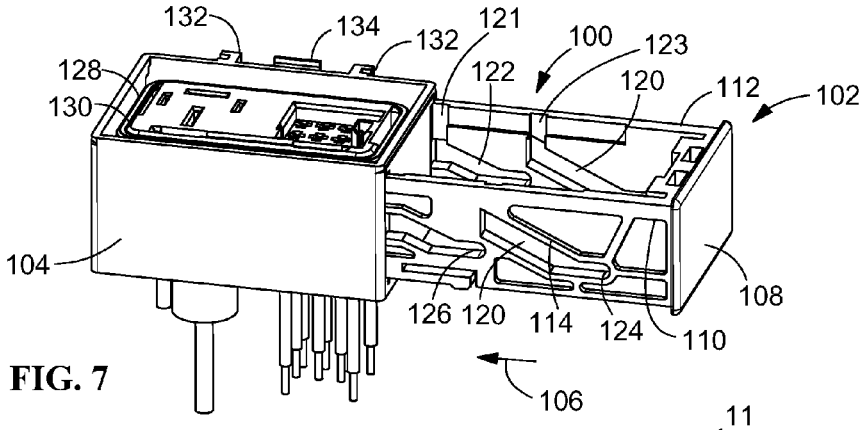
Figure 9:
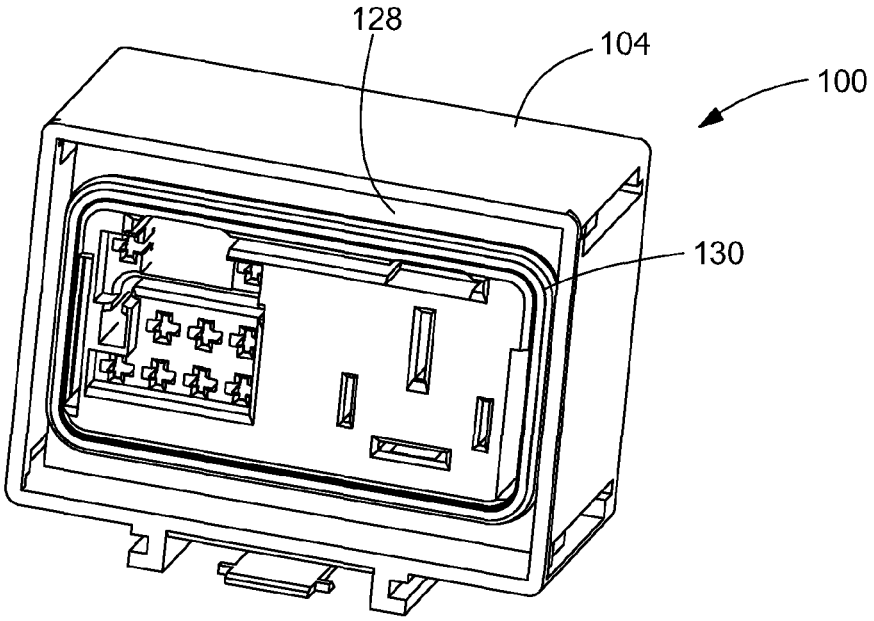
FIG. 9 is a top perspective view of the mating connector of FIG. 7.

As best shown in FIGS. 7 and 9, a peripheral seal 130 may also be provided on the mating connector 100. The seal 130 extends into the recess 128 to cooperate with the cover assembly 10 when the cover assembly 10 is inserted into the recess. The seal 130 may be captively secured on the mating connector 100 or may be a separate member from the mating connector 100.

In the fully inserted position, the seal 52 provide in the connector receiving recess 12 of the cover 11 cooperates with the mating connector 100 to provide a seal there between. In addition, the peripheral seal 130 also cooperates with the cover 11 to provide an additional seal there between. This allows the electrical components 20, 22 housed in the cover assembly 10 to be sealed and isolated from the environment, allowing placement of these components in areas of harsh splash or the like. The choice of location is limited only by the integrity of connector seal.

Figure 8:
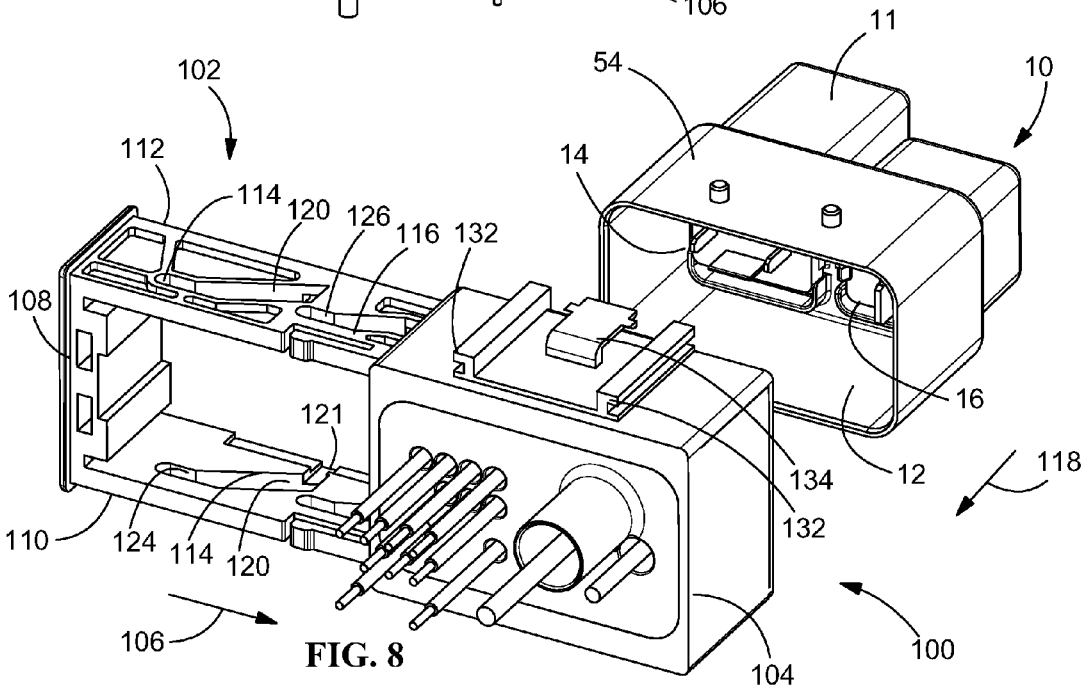
FIG. 8 is a bottom perspective view of the cover assembly and mating connector of FIG. 7.

As shown in FIGS. 7 and 8, the housing 104 of the mating connector 100 may include rails 132 provided on one side thereof. A securing member 134 is positioned between the rails 132. The rails 132 and the securing member 134 engage mating projections in the mating compartment (not shown) to properly position and maintain the mating connector 100 and the cover assembly 10 in the engine compartment or the like.

Figure 11:
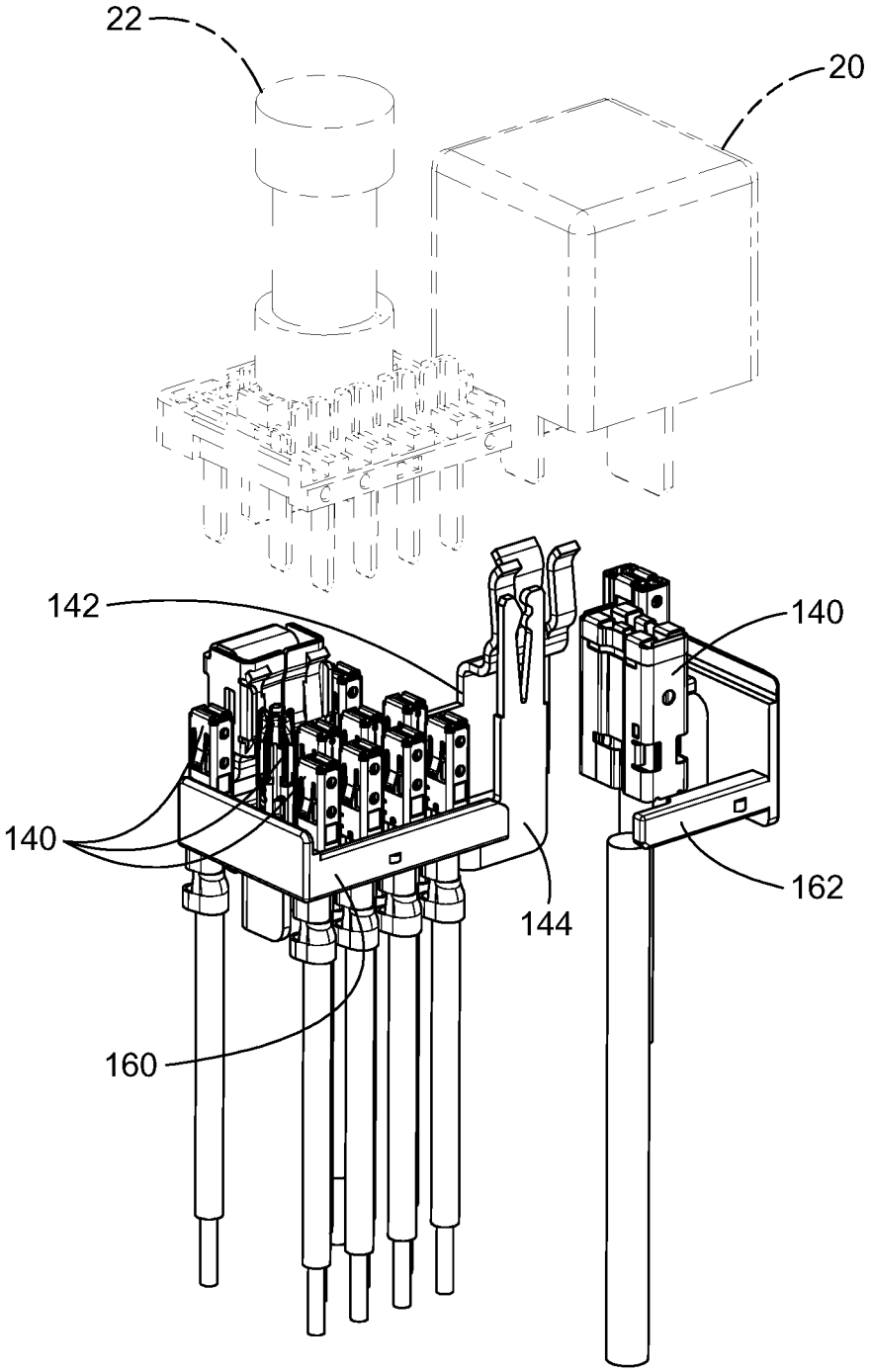
FIG. 11 is a perspective of the contacts of the mating connector of FIG. 7 with the housing removed and the components shown in phantom to better illustrate the contacts and two terminal position assurance members.

Referring to FIG. 11, an illustrative configuration of the contacts 140 of the mating connector 100 is shown. The housing is not shown to better illustrate the contacts 140. The bus bars 142, 144 are provided to extend between the first electrical component 20 and the second electrical component 22. The bus bar 142, 144 may be configured to allow up to 30 A current between the first electrical component 20 and the second electrical component 22. Alternatively, the bus bar 142, 144 may be configured to allow up to 70 A current between the first electrical component 20 and the second electrical component 22. The bus bars may also be configured to accommodate other amperage as required. The configuration of the bus bars 142, 144 is dependent upon the particular components that are to be positioned in the respective component receiving recesses.

In various embodiments, the mating connector 100 include two slideable terminal position assurance members 160, 162, as shown in FIG. 11. In such embodiments, each terminal position assurance member 160, 162 is configured to cooperate with either the contacts 100 which mate with the first electrical component 20 or the contacts 100 that mate with the second electrical component 22, thereby providing a separate terminal position assurance device for the contacts 100 which mate with each electrical component housed in the cover assembly 10. The terminal position assurance members 160, 162 cannot be fully inserted unless the contacts 140 are fully inserted into the mating connector 100.

Figure 12:
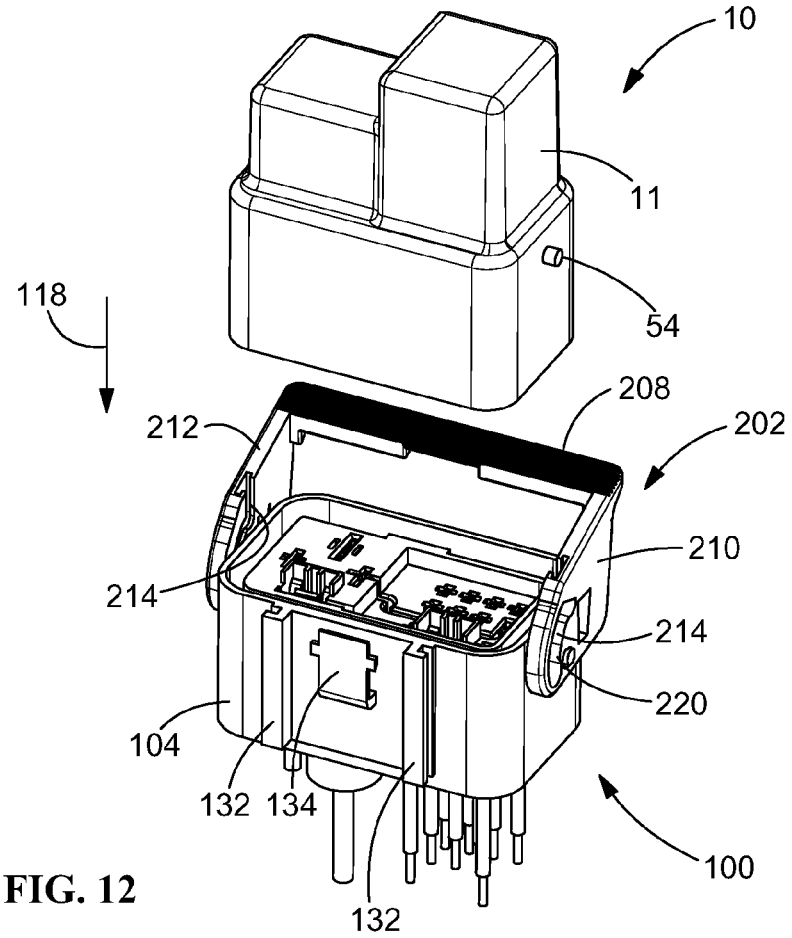
FIG. 12 is a perspective view of an alternate illustrative cover assembly positioned proximate an alternate illustrative mating connector.
Figure 13:
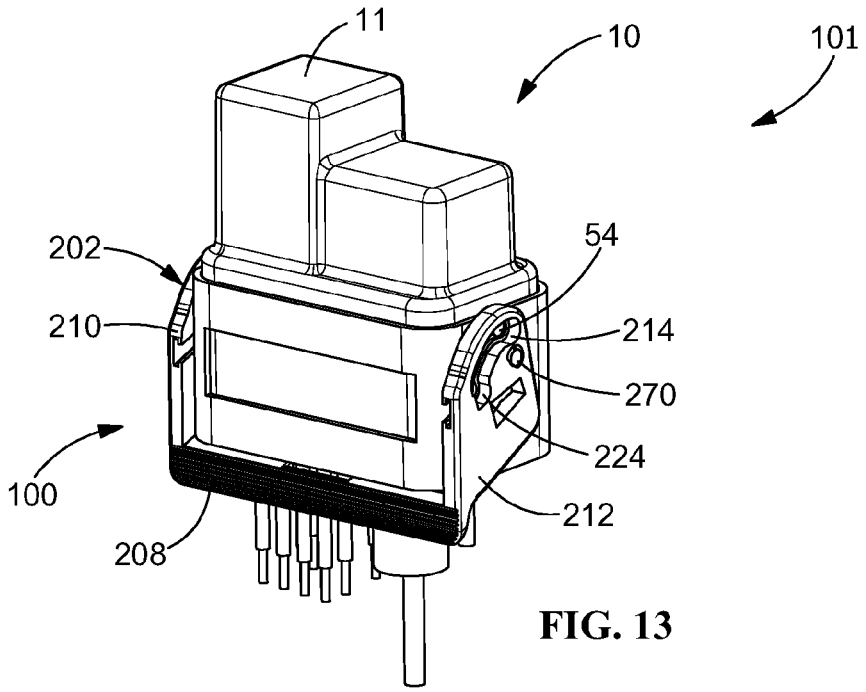
FIG. 13 is a perspective view of the cover assembly of FIG. 12 mated to the mating connector of FIG. 12, the mating connector being in the closed position.

As best shown in FIGS. 12 and 13, the mating connector 100 and the mating connector assembly 101 includes a rotatable locking lever 202 for clamping the cover assembly 10 and the mating connector 100 together. The rotatable locking lever 202 is rotatable about pin or projection 270. The rotatable locking lever 202 includes an engagement or actuating surface 208, to which a displacement force can be applied for displacing the rotatable locking lever 202.

The rotatable locking lever 202 comprises side elements 210, 212. First guide rails 214 are provided in the side elements 210, 212. The first guide rails 214 are formed, for example, as guide openings in this embodiment of the invention. However, the first guide rails may be in other configurations, such as, but not limited to, recesses.

The proposed direction for plugging together the cover assembly 10 and the mating connector 100 is indicated by arrow 118. The first guide rails 214 have step-down portions 220. The first guide rails 214 also comprise end portions 224. The first guide rails 214 cooperate with the associated projections 54 on the cover assembly 10 for securing or clamping the cover assembly 10 and the mating connector 100.

The cover assembly 10 and mating connector 100 allow for the first electrical component 20 or other electrical component and the second electrical component 22 or other electrical component to be position proximate to each other, thereby reducing the space required for the components. In addition, the positioning of the components allows for the use of bus bars and the like, eliminating the need for more complex wire harnesses. This reduces the cost and complexity of the interconnections. The use of the cover assembly 10 and mating connector 100 also reduces the assembly time required to assemble the components and the system. With the reduction of size, material cost savings are also realized.

In the illustrative embodiment shown, the cover assembly and mating connector form an environmentally sealed electrical housing assembly. The housing assembly forms a sealed compartment that protects the removable components from the environment. The housing assembly allows distribution of power switching functions and circuit protection to be distributed to a location near the electrical load instead of from a central location in a vehicle. The housing assembly provides protection of the electrical components from the environment allowing placement of these components outside of a protective enclosure, such as a bussed electrical center. The housing assembly may be placed in areas of harsh splash or the like. The choice of location is limited only by the integrity of connector seal.

While the invention has been described with reference to a preferred embodiment, it will be understood by those skilled in the art that various changes may be made and equivalents may be substituted for elements thereof without departing from the spirit and scope of the invention of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A connector assembly comprising:

a first electrical component;

a second electrical component;

a cover assembly housing the first electrical component and the second electrical component, the cover assembly comprising:

a mating connector receiving recess, a first component receiving recess and a second component receiving recess;

a separating wall is positioned between the first component receiving recess and the second component receiving recess, the wall mechanically and electrically separates the first component receiving recess from the second component receiving recess;

first latches positioned in the first component receiving recess proximate the mating connector receiving recess, the first latches cooperate with the first electrical component to maintain the first electrical component in the first component receiving recess;

second latches positioned in the second component receiving recess proximate the mating connector receiving recess, the second latches cooperate with the second electrical component to maintain the second electrical component in the second component receiving recess;

a seal is provided about an inside perimeter of the mating connector receiving recess;

a mating connector having bus bars to electrically connect the first electrical component to the second electrical component;

wherein when the cover assembly is mated to the mating connector, a sealed compartment is provided that protects the first electrical component and the second electrical component from the environment.

2. The connector assembly as recited in claim 1, wherein the mating connector has slidable terminal position assurance members, each terminal position assurance member is configured to cooperate with either contacts which mate with the first component or contacts which mate with the second component, thereby providing a separate terminal position assurance device for the contacts which mate with the first electrical component housed in the cover assembly and the second electrical component housed in the cover assembly.

3. The connector assembly as recited in claim 1, wherein the mating connector includes rails and a securing member positioned between the rails to properly position and maintain the mating connector and the cover assembly in an engine compartment.

4. The connector assembly as recited in claim 1, wherein projections extend from the cover assembly proximate the mating connector receiving recess.

5. The connector assembly as recited in claim 4, wherein the mating connector has a slidable locking lever which cooperates with projections of the cover assembly.

6. The connector assembly as recited in claim 4, wherein the mating connector has a rotatable locking lever which cooperates with projections of the cover assembly.

7. The connector assembly as recited in claim 4, wherein a recess extends about an inside perimeter of a housing of the mating connector into which the mating connector receiving recess and the projections are positioned.

8. The connector assembly as recited in claim 7, wherein a peripheral seal is provided on the mating connector, the seal extends into the recess to cooperate with the cover assembly when the cover assembly is inserted into the recess.

9. The connector assembly as recited in claim 1, wherein the first latches have first resilient arms which extend from sidewalls of the first component receiving recess, first latching projections with first latching shoulders extend from the first resilient arms and extend into the first component receiving recess to cooperate with and maintain the first electrical component in the first component receiving recess.

10. The connector assembly as recited in claim 9, wherein the second latches have second resilient arms which extend from sidewalls of the second component receiving recess, second latching projections with second latching shoulders extend from the second resilient arms and extend into the second component receiving recess to cooperate with and maintain the second electrical component in the second component receiving recess.

11. A cover assembly for mating a first electrical component and a second electrical component to a mating connector, the cover assembly comprising:

a mating connector receiving recess, a first component receiving recess and a second component receiving recess;

a separating wall positioned between the first component receiving recess and the second component receiving recess, the separating wall mechanically and electrically separates the first component receiving recess from the second component receiving recess;

first latches positioned in the first component receiving recess proximate the mating connector receiving recess, the first latches cooperate with the first electrical component to maintain the first electrical component in the first component receiving recess;

second latches positioned in the second component receiving recess proximate the mating connector receiving recess, the second latches cooperate with the second electrical component to maintain the second electrical component in the second component receiving recess.

12. The cover assembly as recited in claim 11, wherein a seal is provided about an inside perimeter of the mating connector receiving recess.

13. The cover assembly as recited in claim 11, wherein projections extend from outside surfaces of the cover assembly proximate the mating connector receiving recess.

14. The cover assembly as recited in claim 11, wherein the first electrical component is a relay.

15. The cover assembly as recited in claim 11, wherein the second electrical component is a heater control unit.

16. The cover assembly as recited in claim 11, wherein the first latches have first resilient arms which extend from sidewalls of the first component receiving recess, first latching projections with first latching shoulders extend from the first resilient arms and extend into the first component receiving recess to cooperate with and maintain the first electrical component in the first component receiving recess.

17. The cover assembly as recited in claim 16, wherein the second latches have second resilient arms which extend from sidewalls of the second component receiving recess, second latching projections with second latching shoulders extend from the second resilient arms and extend into the second component receiving recess to cooperate with and maintain the second electrical component in the second component receiving recess.

* * * * *